US010369406B2

(12) United States Patent
Mosher

(10) Patent No.: US 10,369,406 B2
(45) Date of Patent: Aug. 6, 2019

(54) LUMBAR DECOMPRESSION DEVICE

(71) Applicant: Eric Eugene Mosher, North Ogden, UT (US)

(72) Inventor: Eric Eugene Mosher, North Ogden, UT (US)

( * ) Notice: Subject to any disclaimer, the term of this patent is extended or adjusted under 35 U.S.C. 154(b) by 44 days.

(21) Appl. No.: 14/681,798

(22) Filed: Apr. 8, 2015

(65) Prior Publication Data

US 2016/0296792 A1 Oct. 13, 2016

(51) Int. Cl.

| | |
|---|---|
| ***A61H 1/02*** | (2006.01) |
| ***A63B 21/00*** | (2006.01) |
| ***A63B 23/02*** | (2006.01) |
| ***A63B 21/068*** | (2006.01) |

(52) U.S. Cl.

CPC ..... *A63B 23/0238* (2013.01); *A61H 1/0229* (2013.01); *A61H 1/0292* (2013.01); *A63B 21/00047* (2013.01); *A63B 21/068* (2013.01); *A61H 2201/0157* (2013.01); *A61H 2201/0192* (2013.01); *A61H 2201/1284* (2013.01); *A61H 2201/1614* (2013.01); *A61H 2203/0487* (2013.01)

(58) Field of Classification Search

CPC .... A63B 1/00; A63B 21/00047–00054; A63B 21/00185; A63B 21/002–0023; A63B 21/068; A63B 21/4029; A63B 3/00; A63B 23/1227; A63B 2023/006; A61H 2003/0205; A61H 2003/0272; B25H 1/06

See application file for complete search history.

(56) References Cited

U.S. PATENT DOCUMENTS

| | | | | |
|---|---|---|---|---|
| 4,323,236 | A * | 4/1982 | Szabo | A63B 21/0615 482/97 |
| 4,890,606 | A | 1/1990 | Iams et al. | |
| 5,025,820 | A | 6/1991 | Gamper | |
| 5,407,404 | A * | 4/1995 | Killian | A63B 21/4047 482/123 |
| 5,862,824 | A | 1/1999 | Herman | |
| 6,217,483 | B1 * | 4/2001 | Kallassy | A63B 21/068 482/38 |
| 7,125,371 | B2 * | 10/2006 | Henderson | A63B 21/068 482/142 |
| 7,354,414 | B2 | 4/2008 | Perrego | |
| 7,581,556 | B2 | 9/2009 | Haslach, Jr. et al. | |
| 7,673,640 | B2 | 3/2010 | Haslach, Jr. et al. | |
| 2007/0173801 | A1 | 7/2007 | Hipp | |
| 2008/0283103 | A1 | 11/2008 | Jacobs et al. | |

(Continued)

FOREIGN PATENT DOCUMENTS

| | | |
|---|---|---|
| CN | 203885806 | 10/2014 |
| EP | 1106161 A2 | 6/2001 |
| WO | 199513783 | 5/1995 |

*Primary Examiner* — Jennifer M Deichl
(74) *Attorney, Agent, or Firm* — Workman Nydegger

(57) ABSTRACT

A lumbar decompression device may include one or more bases that support one or more uprights with a plurality of upper support members and a plurality of lower support members. The upper support members are configured to engage with a user's upper body and support a user's body weight. The one or more uprights are positioned laterally from the upper support members such that the user may perform a variety of movements of their lower body without contacting the one or more uprights.

21 Claims, 7 Drawing Sheets

(56) References Cited

U.S. PATENT DOCUMENTS

| | | | | |
|---|---|---|---|---|
| 2013/0324383 | A1* | 12/2013 | Rogers | A63B 26/00 482/142 |
| 2014/0116484 | A1 | 5/2014 | Demski et al. | |
| 2015/0031514 | A1* | 1/2015 | Deis | A63B 21/15 482/142 |

* cited by examiner

LUMBAR DECOMPRESSION DEVICE

BACKGROUND OF THE DISCLOSURE

Millions of people suffer from lower back problems. Treatments for lower back pain, while readily available, are inconvenient and expensive. The most common treatment of lower back pain to reduce compression of or pressure on the lower back. The reduction of compression of the lower back allows the muscles to stretch and relax and the cartilage to decompress and open fluid passageways through the lower back to relieve pain and increase range of movement. Chiropractic techniques manually manipulate the back to increase blood flow around the spine and through the muscles supporting the spine. Massage therapy techniques seeks to provide the same manual relaxation of the muscles and to promote blood flow. However, both chiropractic and massage therapies commonly require appointments to be made in advance, while lower back pain is frequently acute pain that is caused by daily activities that may not correlate conveniently to a treatment schedule. The appointment structure of chiropractic and massage therapy, therefore, is less than ideal to treat acute lower back pain.

A number of at-home devices and/or techniques are available for treating lower back pain that allow for the decompression of the lower back. A common device for the treatment of lower back pain at home is an inversion table. An inversion table allows a user to restrain their feet at a base of the inversion table and then manually invert themselves and the table to substantially reverse the force of gravity on the user's back. Inversion tables are large and expensive, however, and require the user to be physically inverted. Inversion may be hazardous to the health of some individuals, as the inversion process alters the blood flow and pressure of the blood to sensitive areas, such as the brain, lungs, and heart. Furthermore, inversion may cause general discomfort and/or nausea in some users, deterring the use of an inversion table. An inversion table also requires the user to lie against the table, either on the user's back or front. The user's range of movement is therefore limited as the balance of the inversion table will be altered if the user tried to bend at the back and/or waist, and the user's torsional range of movement is also limited as their feet are restrained and they are lying with their shoulders against the flat table surface.

Thus, an affordable and simple device for the decompression of the lower back that is usable in a home environment without requiring the inversion of the user and without restricting their movement may be desirable.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In an embodiment, a lumbar decompression device includes at least one base, a plurality of upper support members, at least one upright, and a plurality of lower support members. The upper support members are configured to apply a force to a user's torso and the plurality of upper support members defines a first width. The at least one upright connects the plurality of upper support members to the at least one base and the at least one station is oriented at an angle from the base in a range of 45° to 80°. The plurality of lower support members are connected to the at least one upright and configured to apply a force to a user's lower arm. The plurality of lower support members defines a second width, wherein the second width is greater than the first width.

In another embodiment, a lumbar decompression device includes a first base and a second base, a first upright and a second upright, and a first upper support member and a second upper support member. A first end of the first upright is connected to the first base and a first end of the second upright is connected to the second base. One or more support plates connect and reinforce the first upright in a forward and rearward direction relative to the first base. The first upper support member connects to a second end of the first upright and the second upper support member connects to a second end of the second upright.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
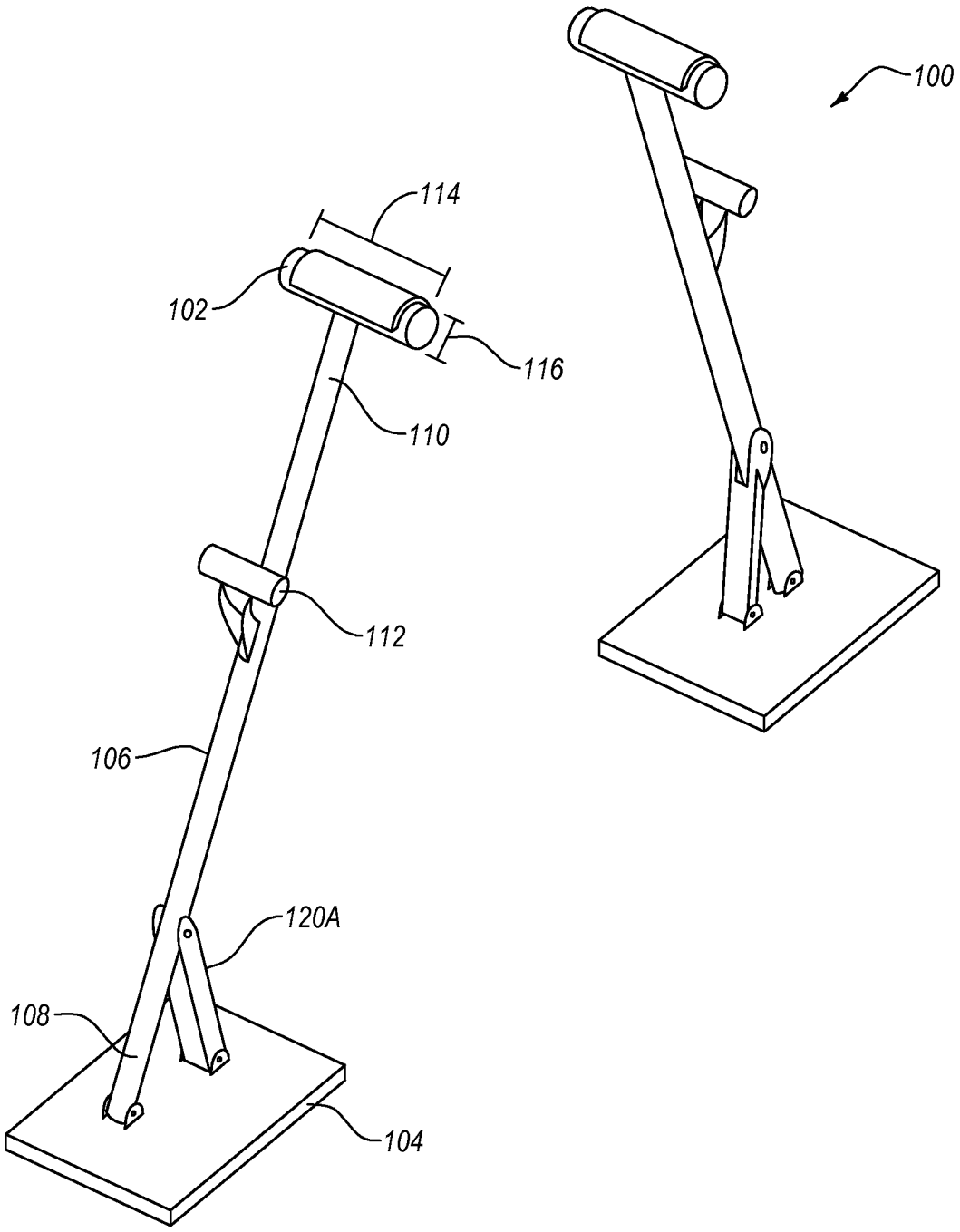
FIG. 1 is a perspective view of an embodiment of a lumbar decompression device according to the present disclosure.

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure. Any elements described in relation to any embodiment disclosed herein may be combinable with any elements described in relation to any other embodiments disclosed herein. For example, any element described in relation to a Figure may be freely combinable with any elements or embodiments described in relation to other Figures.

One or more embodiments of the present disclosure may generally relate to constructing and using a lumbar decompression device that may reduce pressure on a user's lower back. The lumbar decompression device may also support a user's bodyweight above their lower back to decompress the lower back while allowing the user to move their lower body relative to their upper body. Movement of the user's lower body may increase blood flow and/or move the muscles of the lower back during decompression, providing additional relief from the pain and discomfort associated with acute lower back pain. It should be understood that while the present disclosure may refer to acute lower back pain, a lumbar decompression device according to the present disclosure may be used to provide relief from chronic back pain.

A lumbar decompression device may include a pair of upper support members that are configured to support a user's bodyweight at or near the user's torso. For example, the upper support members may be configured to support a user's bodyweight by applying a force to the user's underarm. The lumbar decompression device may allow the user to hang from the upper support members with little or no physical exertion on the part of the user. The upper support members may be connected to one or more uprights that connect the upper support members to one or more bases. The bases may be a stable platform upon with the uprights extend, such that the lumbar decompression device is free-standing and self-supporting both when in use and when not in use. The uprights may be adjustable in length. The uprights may also be oriented at an angle to the one or more bases to provide space for the user to move their lower body through a range of movements without interference or contact with the lumbar decompression device.

A lumbar decompression device may also include a plurality of lower support members that provide additional stability and control for a user when the user's bodyweight is substantially supported by the upper support members. The lower support members may be configured to provide support to a user's lower arm or hands. The lower support members may allow the user to stabilize themselves on the upper support members and/or while moving their lower body through a range of motion relative to their upper bodies. The position of the lower support members may be adjustable along a length of the one or more uprights.

FIG. 1 depicts an embodiment of a lumbar decompression device 100, according to the present disclosure. The lumbar decompression device 100 includes a plurality of upper support members 102 and a plurality of bases 104 with a plurality of uprights 106 extending therebetween. Each of the uprights 106 may be connected to one of the bases 104, respectively, at a first end 108 and each of the uprights 106 may have an upper support member 102 connected to the upright 106 at a second end 110. The lumbar decompression device 100 has a plurality of lower support members 112 that may be connected to the uprights 106 between the first end 108 and the second end 110.

The uprights 106 may be made of or include various materials to provide the strength to support the weight of a user during use of the lumbar decompression device 100. In some embodiments, the uprights 106 may be made of or include metal, wood, carbon fiber, plastic, other material, or combinations thereof. For example, the uprights 106 may be made of or include iron, aluminum, titanium, alloys thereof, other metals, or combinations of metals. In other example, a portion of the upright 106 (e.g., a bottom portion) may be made of a first material, and another portion of the upright 106 (e.g., a top portion) may be made of a second material. While the uprights 106 are depicted as having a circular cross-section (i.e., round), it should be understood that the uprights 106 may have any cross-sectional shape that allows sufficient rigidity and adjustability to support the weight of a user during use of the lumbar decompression device 100. For example, the uprights 106 may have cross-sectional shape that is square, triangular, elliptical, octagonal, other polygonal, irregular, or combinations thereof.

The upper support members 102 may be configured to engage a user's underarm. The upper support members 102 may be padded, such as with a memory foam, a gel pad, a honeycomb pad, a closed cell foam, an open cell foam, leather, rubber, other elastomer, an antimicrobial material, other padding material, or combinations thereof. The upper support members 102 may each have a length 114 and a width 116. The length 114 of the upper support member 102 may be within a range having upper and lower values including any of 4 inches, 6 inches, 8 inches, 10 inches, 12 inches, and any value therebetween. For example, the length 114 of the upper support member 102 may be within a range of 4 inches to 12 inches. In another example, the length 114 of the upper support member 102 may be within a range of 6 inches to 10 inches. In yet another example, the length 114 of the upper support member 102 may be 8 inches.

The width 116 of the upper support member 102 may be within a range having upper and lower values including any of 1 inch, 2 inches, 3 inches, 4 inches, 5 inches, 6 inches, or any value therebetween. For example, the width 116 of the upper support member 102 may be within a range of 1 inch to 6 inches. In another example, the width 116 of the upper support member 102 may be within a range of 2 inches to 5 inches. In yet another example, the width 116 of the upper support member 102 may be within a range of 3 inches to 4 inches.

The upper support member 102 may have different contours along the length 114 of the upper support member 102. While depicted in FIG. 1 as being substantially straight along the length 114, in some embodiments, at least a portion of the upper support member 102 along the length 114 may be convex when viewed in profile. In other embodiments, at least a portion of the upper support member 102 along the length 114 may be concave when viewed in profile. In yet other embodiments, at least a portion of the upper support member 102 along the length 114 may be substantially straight. For example, the upper support member 102 may be contoured along the length 114 to engage with the underarm of a user. The upper support member 102 may have different contours along the width 116 of the upper support member 102. While shown as being substantially round (i.e., cylindrical) and therefore having a convex surface along the width 116, in some embodiments, at least a portion of the upper support member 102 along the width 116 may be convex. In other embodiments, at least a portion of the upper support member 102 along the width 116 may be concave. In yet other embodiments, at least a portion of the upper support member 102 along the width 116 may be substantially straight and, therefore, have a flat surface.

The lower support members 112 may be configured to engage with and provide support to the user's lower arm. In some embodiments, the lower support members 112 may be connected to an "outside" of the uprights 106 (i.e., may be positioned relative to the uprights 106 such that both uprights 106 are located between the lower support members 112). The lower support member 112 may be adjustably connected to the uprights 106 to accommodate users having different length arms.

The one or more bases 104 may be made of or include a material to increase friction between the one or more bases 104 and a surface upon which the lumbar decompression device 100 may be used. For example, the one or more bases 104 may include a rubber or elastomer material to increase the coefficient of friction between the one or more bases 104 and a floor. In another example, the one or more bases 104 may include a textured surface on the bottom of the one or more bases to resist movement of the one or more bases 104 relative to the surface upon which the lumbar decompression device 100 is used.

A connection between the uprights 106 and the bases 104 may be supported by a brace member 120A. The brace member 120A may be positioned at or near the first end 108 of the upright 106. The brace member 120A may, in some embodiments, be positioned at an angle to the upright 106 to provide support to the upright 106 when the upright 106 is angled toward a user and/or when force is applied to the upright 106 substantially in the direction of the brace member 120A.

Figure 2:
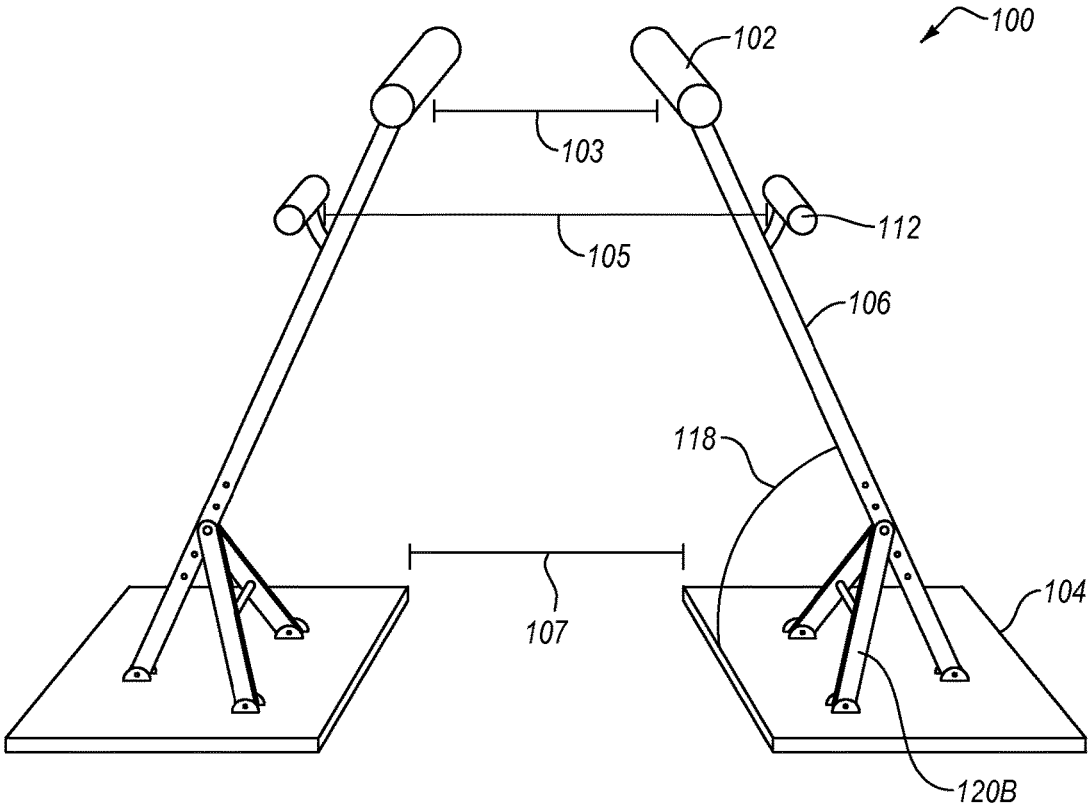
FIG. 2 is a front view of another embodiment of a lumbar decompression device.

FIG. 2 is a side view of an embodiment of a lumbar decompression device 100 similar to that depicted in FIG. 1 with an alternative brace member 120B. The uprights 106 of the lumbar decompression device 100 may form an angle 118 with the one or more bases 104. In some embodiments, an entire upright 106 may have a substantially constant angle 118. In other embodiments, the uprights 106 may have a vertical portion and an angled portion. The vertical portion may form a 90° angle relative to the one or more bases, and the angled portion may extend from the vertical portion at angle and form the angle 118 with the one or more bases 104. In some embodiments, the angle 118 may be adjustable. In other embodiments, the angle 118 may be fixed. The angle 118 may be within a range having upper and lower values including any of 45°, 50°, 55°, 60°, 65°, 70°, 75°, 80°, 85°, or any value therebetween. For example, the angle 118 may be between 45° and 85°. In another example, the angle 118 may be between 55° and 80°. In yet another example, the angle 118 may be between 65° and 75°.

The angle 118 may be adjustable by movement of one or more brace members 120B in contact with the one or more uprights 106. For example, a brace member 120B may be positioned in contact with an upright 106 and a base 104, as shown in FIG. 2. In some embodiments, the brace member 120B may be rotatably connected to the base 104 and may be movably connected to the upright 106. In other embodiments, the brace member 120B may be rotatably connected to the upright 106 and movably connected to the base 104. For example, the brace member 120B may be movably connected to the upright 106 by one or more retention members. In some embodiments, the retention members may be cross pins that may be positioned through a hole in the brace member 120B and a hole in the upright 106. In other embodiments, the retention members may be clamps or other devices connected to the brace member 120B and configured to apply a compressive force to the upright 106 and, thereby, limit or prevent movement of the brace member 120B relative to the upright 106.

In some embodiments, a brace member 120B may be configured to provide additional support and/or stability substantially perpendicular to the direction of the angle. In other words, the brace member 120B may provide additional support and/or stability in the forward and rearward direction from the perspective of a user. For example, the brace member 120B may be a triangular brace with a greater width at or near the base 104 than at or near the upright 106. In other embodiments, a plurality of brace members 120B may engage with the upright 106. At least one of the plurality of brace members 120B may provide additional support and/or stability to the upright 106 in a forward direction and at least one of the plurality of brace members 120B may provide additional support and/or stability to the upright 106 in a rearward direction.

Figure 3:
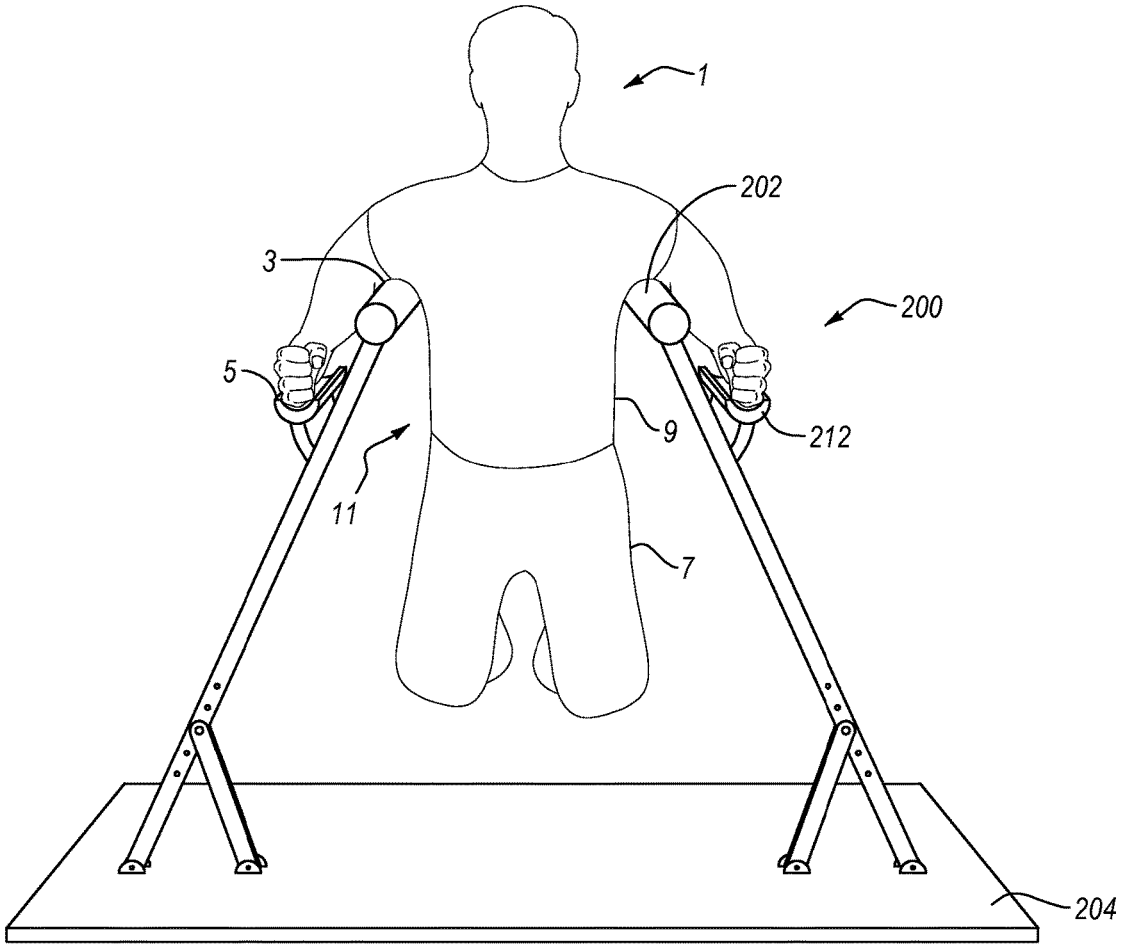
FIG. 3 is a front view of an embodiment of a lumbar decompression device having a single base in use.

In the depicted embodiment of the lumbar decompression device 100, the lower support members 112 are configured to engage with a user's hand. FIG. 3 depicts another embodiment of a lumbar decompression device 200 having upper support members 202 to engage with the underarm 3 region of a user 1 and lower support members 212 that are configured to engage with a user's forearms 5. The pair of upper support members 202 may be configured to substantially support the bodyweight of the user 1. The lower support members 212 may have a concave surface that complimentarily supports the user's forearms 5. In some embodiments, the lower support members 212 may allow the user 1 to at least partially distribute their bodyweight across their forearms 5 to reduce the pressure on their underarms 3 from the upper support members 202. In other embodiments, the lower support members 212 may allow the user 1 to stably support their body weight while moving their lower body 7 relative to their upper body 9 and the lumbar decompression device 200. For example, while user 1 is supported by lumbar decompression device 200, the user 1 may rotate their lower body 7 relative to their upper body 9 and the lumbar decompression device 200. In another example, the user 1 may lift their lower body 7 toward their upper body 9 by moving their lower body 7 forward and/or backward. In yet another example, the user 1 may move their lower body 7 laterally (i.e., left and/or right) to aid in the decompression of the user's lower back 11.

As shown in FIG. 2, the upper support members 102 of the lumbar decompression device 100 may define a first width 103, the lower support members 112 may define a second width 105, and the bases 104 may define a third width 107. In some embodiments, the first width 103 may be less than the second width 105. In other embodiments, the first width 103 may be greater than the third width 107. In yet other embodiments, the first width 103 may be less than the second width 105 and greater than the third width 107.

In further embodiments, the first width 103 may be less than the second with and less than the third width.

In one embodiment illustrated in FIG. 3, the lumbar decompression device 200 has a single base 204 to which both uprights 206 may connect. The single base 204 may allow the lumbar decompression device 200 to provide a connection between the uprights 206 that may be angled toward one another. Uprights 206 that are angled toward one another may direct at least part of the weight of a user 1 laterally as well as downward, applying a lateral force on the base 204. As described in relation to FIG. 1, a lumbar decompression device 100 having a plurality of bases may have one or more features to limit the movement of the one or more bases. The single base 204 of the lumbar decompression device 200 may allow any lateral components of the weight of a user 1 to be directed opposing one another by the opposing directions of the uprights 206. The single base 204 may also limit the additional components necessary to limit movement of the base 204 relative to a surface upon which the lumbar decompression device 200 may be used.

Figure 4:
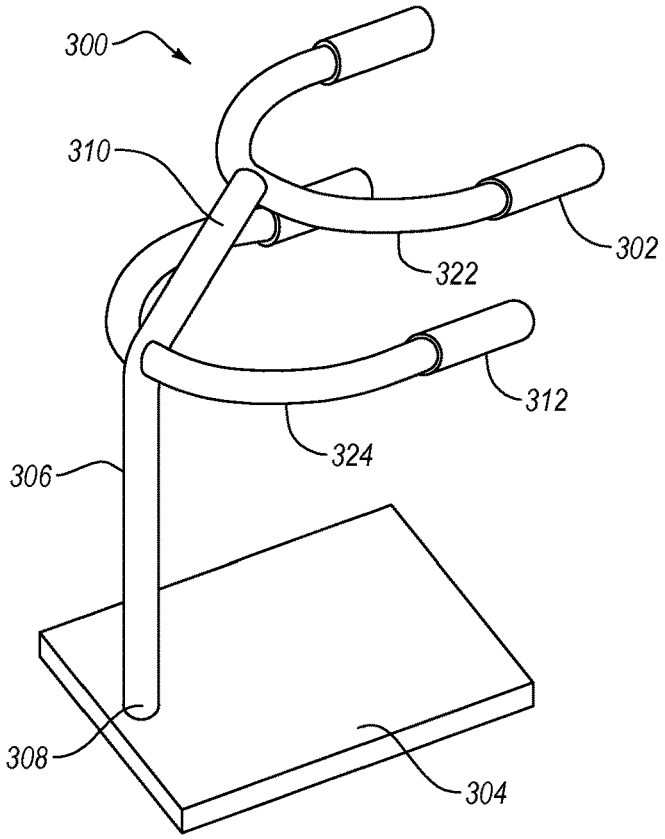
FIG. 4 is a front view of an embodiment of a lumbar decompression device having a single upright.

FIG. 4 depicts another embodiment of a lumbar decompression device 300 according to the present disclosure. The lumbar decompression device 300 has a plurality of upper support members 302 connected to a base 304 by a single upright 306. The upright 306 is connected at a first end 308 to the base 304. The upper support members 302 may be connected to the upright 306 by upper arms 322 that extend from a second end 310 of the upright 306. The lumbar decompression device 300 may also have a plurality of lower support members 312 that are connected to the upright 306 at a point between the first end 308 and second end 310. The lower support members 312 may be connected to the upright 306 by lower arms 324 that extend from a point between the first end 308 and second end 310 of the upright 306.

A lumbar decompression device 300 having a single upright 306 with upper arms 322 and/or lower arms 324 may allow the use of an upright 306 that is substantially normal to the base 304. For example, the upright 306 may extend from the base 304 vertically and the upper arms 322 and/or lower arms 324 may extend from the upright 306 substantially horizontally. The horizontal extension of the upper arms 322 and/or lower arms 324 may allow a user sufficient space to move their lower body through various ranges of movement relative to their upper body, while being supported by the upper arms 322 and/or lower arms 324. The upper arms 322 and/or lower arms 324 may extend horizontally from the point on the upright 306 at which they are connected by a distance within a range having upper and lower values including any of 1 foot, 1.25 feet, 1.5 feet, 1.75 feet, 2.0 feet, 2.25 feet, 2.5 feet, 2.75 feet, 3.0 feet, or any value therebetween.

Figure 5:
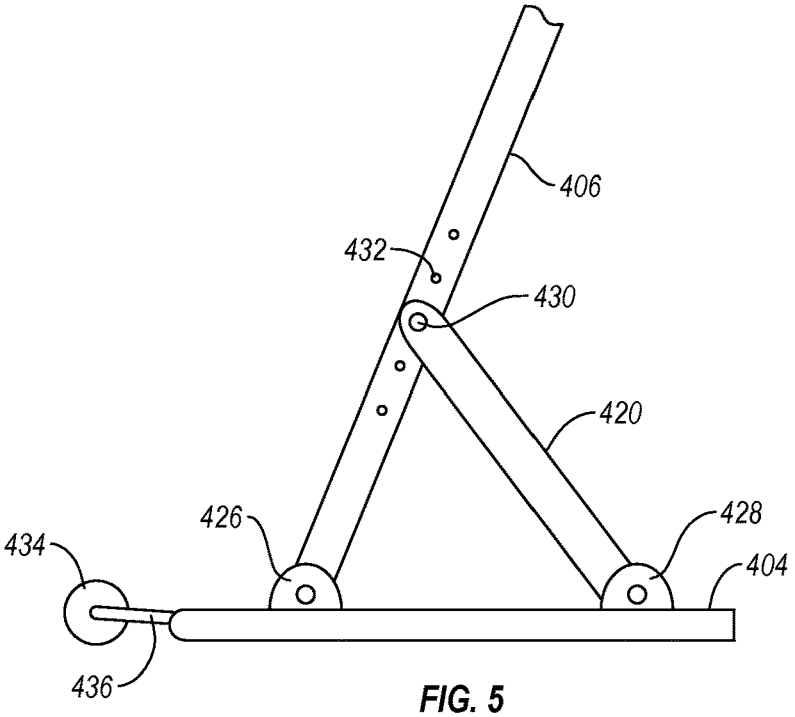
FIG. 5 is a side view of an embodiment of a base configured to provide angular adjustability to a lumbar decompression device.

FIG. 5 depicts an embodiment of at least a portion of a base 404 that may be used in conjunction with a lumbar decompression device having a plurality of bases or a lumbar decompression device having a single base. The base 404 may have an upright 406 and a brace 420 connected thereto. The upright 406 may be movably connected to the base 404 at an upright hinge 426. The upright hinge 426 may allow the upright 406 to pivot relative to the base 404. The brace 420 may be movably connected to the base 404 at a brace hinge 428. The brace hinge 428 may allow the brace 420 to pivot relative to the base 404. The brace 420 may meet the upright 406 at an end of the brace 420 opposite the brace hinge 428. The end of the brace 420 may be connected to the upright 406 by a retention member 430 inserted into and/or through a connection point 432 on the upright 406. An upright 406 may include a plurality of connection points 432 to provide a plurality of positions in which the brace 420 may be connected to the upright 406. Each position may provide a different angle between the base 404 and the upright 406, as described herein. In other embodiments, the brace 420 and upright 406 may be connected to one another by the interaction of a resilient or spring-loaded member and a detent that limits or prevents movement of the brace 420 and upright 406 relative to one another.

The base 404 may also include one or more elements to assist in the movement of the device. A lumbar decompression device according to the present disclosure may be used at home, in an office, or other location convenient to the user. However, the location may have limited space. While the lumbar decompression device may occupy less space than alternative devices, such as an inversion table, it may be desirable to store the lumbar decompression device when not in use. In one embodiment, the base 404 may include one or more wheels 434 located out-of-plane with the base 404 by one or more wheel support members 436. The one or more wheels 434 may, therefore, not be in contact with a surface upon which the lumbar decompression device is used when the upright compression device is in use. However, the one or more wheels 434 may contact the surface when the lumbar decompression device is tilted toward the one or more wheels 434, allowing movement of the lumbar decompression device on the one or more wheels 434. In other embodiments, the one or more wheels 434 may be located in-plane with the base 404 by one or more wheel support members 436 or connected directly to the base 404. For example, the one or more wheels 434 may be in contact with the surface when the base 404 is resting flat against the surface. Any tilting of the base 404 relative to the surface may result in the base 404 being supported by the one or more wheels 434.

In some embodiments, the upright 406 may be disconnected from the brace 420 and pivoted to a wheeling position that is toward or substantially flat with the base 404. The upright 406 may be secured relative to the base 404 in the wheeling position. A user may then lift the upright 406 (e.g., using an upper support member and/or lower support member) to tilt the lumbar decompression device until the one or more wheels 434 contact the surface. The user may then freely wheel the lumbar decompression device to a storage location until the lumbar decompression device is to be used again.

Figure 6:
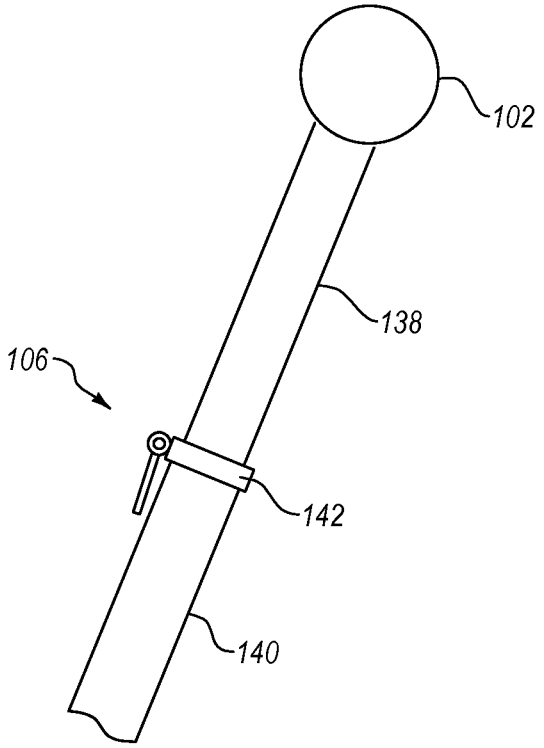
FIG. 6 is a side view of an embodiment of an adjustable upper support member and upright of the lumbar decompression device of FIG. 1.

While the angle between the base 404 and the upright 406 may allow for adjustability of the lumbar decompression device between users, FIG. 6 depicts an upright 106 having a selectable length, providing additional adjustability. The upright 106 may extend from a base to the upper support member 102. The position of the upper support member 102 may be at least partially determined by the length of the upright 106. The length of the upright 106 may be selected by the relative position of an inner upright member 138 and an outer upright member 140. The inner upright member 138 may slide within the outer upright member 140 and may extend from the outer upright member 140. The upper support member 102 may be connected to the inner upright member 138 and the outer upright member 140 may connect to the base. In other embodiments, the upper support member 102 may be connected to the outer upright member 140 and the inner upright member 138 may connect to the base.

The relative position of the inner upright member 138 and the outer upright member 140 may be substantially secured by an upright locking member 142. The upright locking member 142 may be a clamping mechanism that extends circumferentially about the outer upright member 140. The upright locking member 142 may compress the outer upright member 140 against the inner upright member 138. The compression of the outer upright member 140 against the inner upright member 138 may limit or substantially prevent relative movement of the inner upright member 138 and the outer upright member 140. In other embodiments, the upright locking member 142 may include a cross-pin, one or more detents, other mechanical connection, or combinations thereof.

Figure 7:
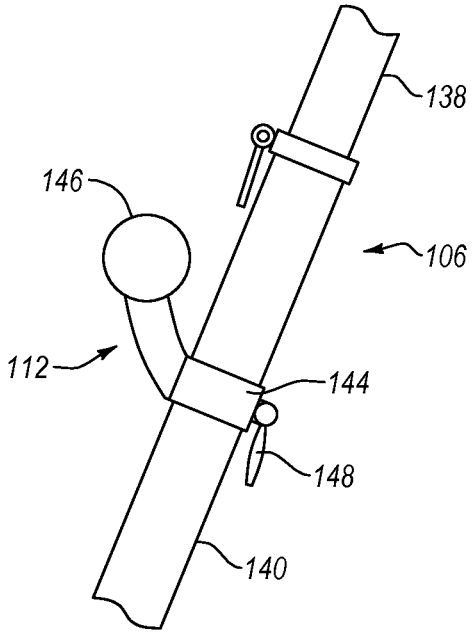
FIG. 7 is an embodiment of an adjustable lower support member of the lumbar decompression device of FIG. 1.

FIG. 7 illustrates an embodiment of an adjustable lower support member 112 that may be adjustable relative to an upright 106. The lower support member 112 includes a support member sleeve 144 and a handle 146. In other embodiments, the handle 146 may be a concave support surface configured to support a user's forearm, as described herein. The support member sleeve 144 may be configured to circumferentially extend around the outer upright member 140 and/or the inner upright member 138. The support member sleeve 144 may be adjustable in diameter by a sleeve locking member 148. The diameter of the support member sleeve 144 may be reduced by moving the sleeve locking member 148 relative to the support member sleeve 144, thereby applying a compressive force to the outer upright member 140 and/or inner upright member 138. The compressive force may substantially fix the position of the lower support member 112 relative to the upright 106.

Figure 8:
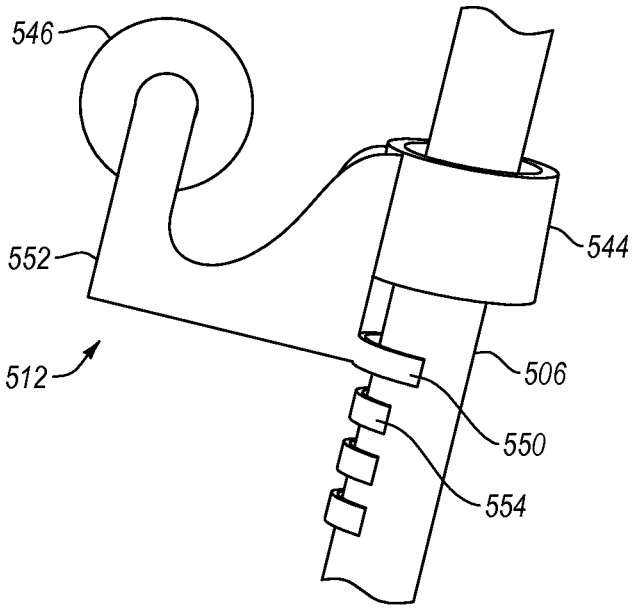
FIG. 8 is a side view of another embodiment of an adjustable lower support member of a lumbar decompression device.

FIG. 8 illustrates another embodiment of an adjustable lower support member 512 that may be adjustable relative to an upright 506. The lower support member 512 may include a support member sleeve 544 positioned around the upright 506 but allowing for space between the support member sleeve 544 and the upright 506. The lower support member 512 may include a handle 546 connected to the support member sleeve 544 such the movement of the support member sleeve 544 relative to the upright 506 may move the handle 546 relative to the upright 506. The lower support member 512 may include a contact plate 550 connected to a body 552 of the lower support member 512. The contact plate 550 may be connected to the body 552 by any suitable method, including mechanical fasteners (e.g., bolts, screws, rivets, threaded rods, nails, clamps, etc.), brazing, welding, adhesive, other connection methods, or combinations thereof. The contact plate 550 may be curved to compliment the exterior shape of the upright 506 and to limit lateral and/or rotational movement of the lower support member 512 relative to the upright 506.

The upright 506 may include one or more shelf plates 554 connected to the upright 506 by any suitable method, including mechanical fasteners (e.g., bolts, screws, rivets, threaded rods, nails, clamps, etc.), brazing, welding, adhesive, other connection methods, or combinations thereof. The shelf plates 554 may be connected to the upright 506 to support the lower support member 512 during use of a lumbar decompression device. The shelf plates 554 may be any size sufficient to support the contact plate 550 of the lower support member 512. The one or more shelf plates 554 may be spaced apart on the upright 506. In some embodiments, the upright 506 may include 1, 2, 3, 4, 5, 6, 7, 8, 9, or 10 shelf plates 554. The one or more shelf plates 554 may be spaced apart by equal amounts between each shelf plate 554 or by varying amounts. In some embodiments, the one or more shelf plates 554 may have a space therebetween in a range having upper and lower values including any of 0.2 inches, 0.4 inches, 0.6 inches, 0.8 inches, 1.0 inches, 1.2 inches, 1.4 inches, 1.6 inches, or any value therebetween.

Figure 9:
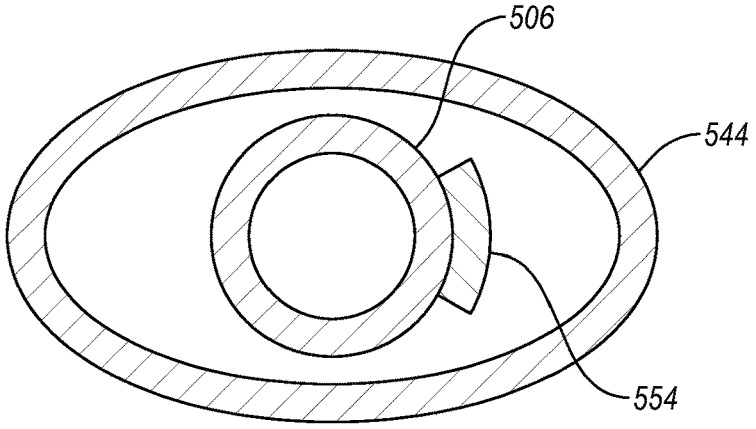
FIG. 9 is a top cross-sectional view of the adjustable lower supper member of FIG. 8.

FIG. 9 is a top cross-sectional view of the support member sleeve 544 and upright 506 of FIG. 8. The shelf plate 554 may be connected to only a portion of the circumference of the upright 506, allowing a support member sleeve 544 to pass by the shelf plate 554 when the support member sleeve 544 has a larger inner diameter (e.g., the major axis of a non-circular support member sleeve) than a width of the upright 506 and the shelf plate 554. In at least one embodiment, a shelf plate 554 may extend around about 3/16 of the circumference of the upright 506. In another embodiment, the support member sleeve 544 may have between about 1/16 inch and 7/16 inch clearance around the upright 506 and the shelf plate 554.

Figure 10:
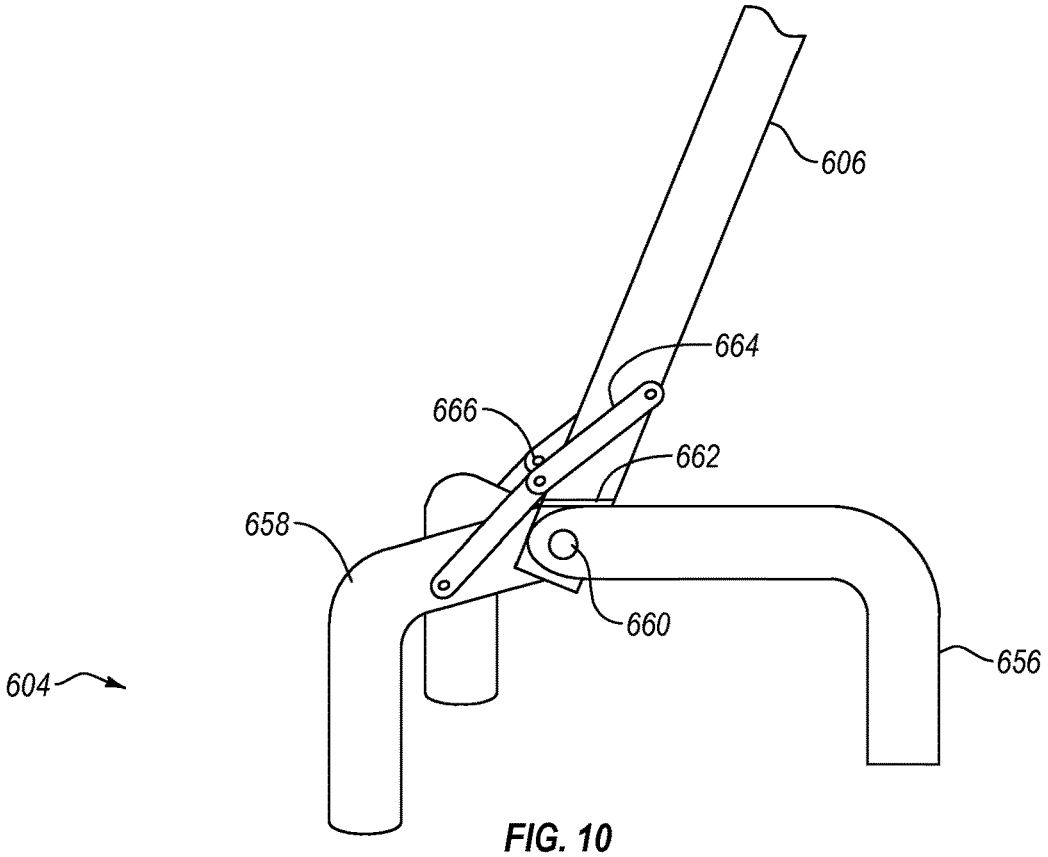
FIG. 10 is a side view of an embodiment of a collapsible base of a lumbar decompression device.

FIG. 10 illustrates another embodiment of a base 604 that may support an upright 606 of a lumbar decompression device. The base 604 may have a plurality of legs positioned at an end of the upright 606 and extending away from the upright 606 to provide stability to the upright 606. For example, the base 604 may include 3, 4, 5, 6, 7, 8, 9, or 10 legs. In some embodiments, all of the legs may be the same length and/or diameter. In other embodiments, the base 604 may include one or more long legs 656 and one or more short legs 658. As shown in FIG. 10, the base 604 may include one a long leg 656 extending substantially underneath the angled upright 606 and a plurality of short legs 658 extending away from the angled upright 606. The plurality of short legs 658 may also extend at least partially in opposing directions from one another, thereby providing additional stability to the upright 606.

At least one of the long legs 656 and/or short legs 658 may be pivotally movable relative to the upright 606. In some embodiments, at least one of the long legs 656 and/or short legs 658 may be connected to the upright 606 via a pivotal connector 660, such as an axle, rivet, bolt, or other cross pin. The pivotal connector 660 may allow the at least one of the long legs 656 and/or short legs 658 to pivot through an arcuate range of motion, facilitating easier storage of the base 604. The arcuate range of motion may be limited by a leg shelf 662 affixed to the upright 606. The leg shelf 662 may be connected to the upright 606 by any suitable method, including mechanical fasteners (e.g., bolts, screws, rivets, threaded rods, nails, clamps, etc.), brazing, welding, adhesive, other connection methods, or combinations thereof. The long leg 656 and/or short leg 658 adjacent the leg shelf 662 may have a rounded end such that the end may slide past the leg shelf 662 until the long leg 656 and/or short leg 658 itself contacts the leg shelf 662, limiting further arcuate motion of the long leg 656 and/or short leg 658 pivoting about the pivotal connector 660.

In other embodiments, the long legs 656 and/or short legs 658 may be connected to the upright 606 by a flexible, hinged, or otherwise collapsible connection member 664 that may be substantially rigid when the long legs 656 and/or short legs 658 are extended. For example, a hinged connection member 664 may extend from the upright 606 to one of the long legs 656 and/or short legs 658 and may lock in place (e.g., by locking the hinge 666 of the hinged connection member 664) to provide support to the long legs 656 and/or short legs 658 from the upright 606. In other embodiments, connection member 664 may provide tensile support to the long legs 656 and/or short legs 658. For example, the upright 606 may extend downward to the surface and the connection member 664 may provide support to the long legs 656 and/or short legs 658 while under tension between one of the long legs 656 and/or short legs 658 and the upright 606 below the pivotal connector 660. A base 604 having one or more pivotally movable long legs 656 and/or short legs 658 may allow for a lumbar decompression device that is more easily transportable and/or storable.

Figure 11:
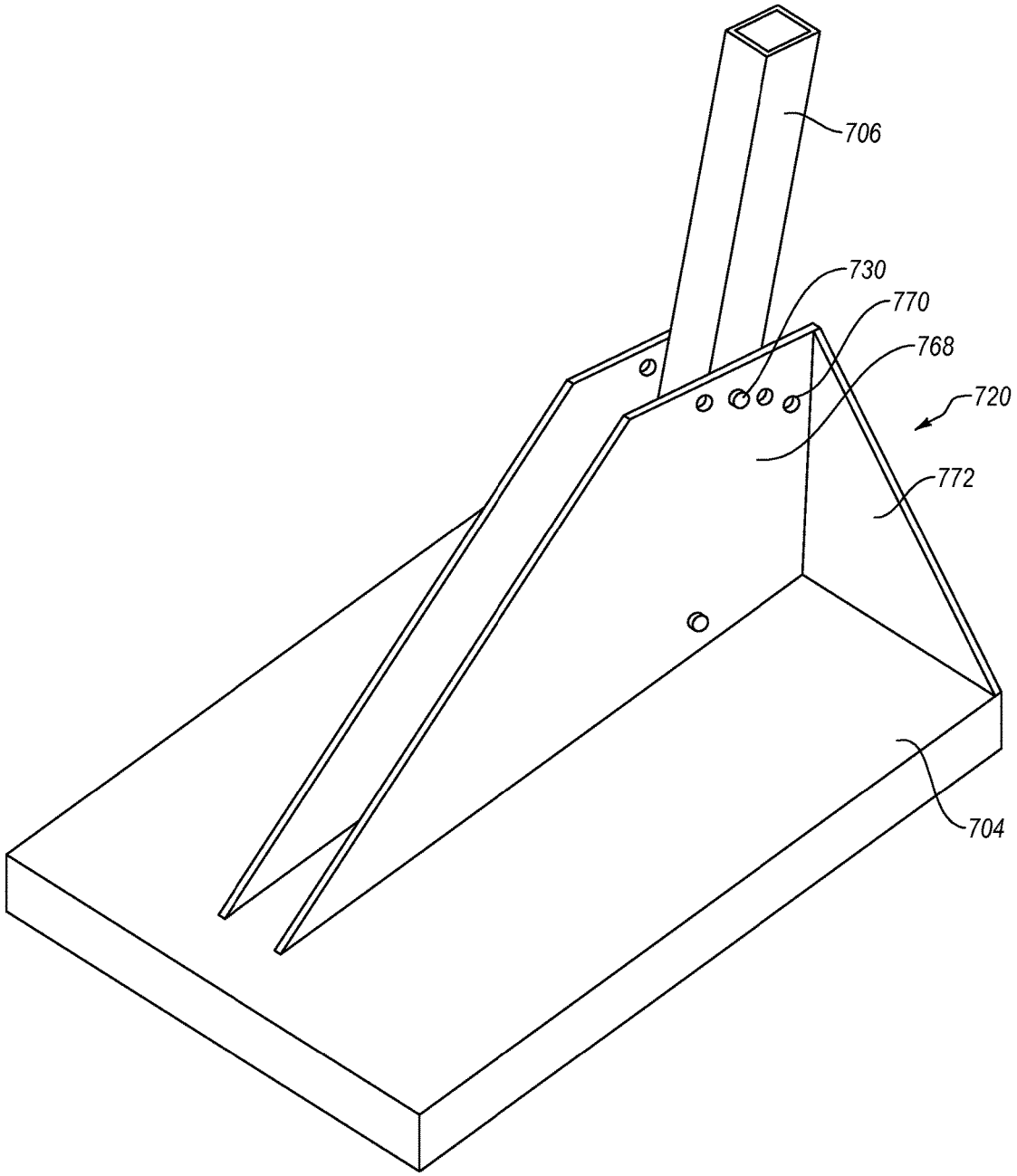
FIG. 11 is a perspective view of a brace reinforced in a forward and rearward direction relative to a user.

In yet other embodiments, the base of a lumbar decompression device may include one or more support plates. As shown in FIG. 11, a base 704 may connect to an upright 706 that is supported by a brace member 720. The brace member 720 may provide support and/or stability to the upright 706 in the direction of a user (i.e., the direction of the tilt of the upright 706). In some embodiments, the brace member 720 may include one or more support plates 768 affixed to the base 704 that may provide additional support and/or stability to the upright 706 while still allowing angular adjustability to the upright 706 by a plurality of adjustment bores 770 in the support plates 768. The brace member 720 may connect to the upright 706 via a retention member 730 that extends through one of the adjustment bores 770 and into the upright 706. In some embodiments, the brace member 720 may include metal support plates 768 welded to the base 704. In other embodiments, the brace member 720 may include lateral buttressing and/or brackets 772 that extend away from the upright 706 in a forward and/or rearward direction. In yet other embodiments, the brace member 720 may include support plates 768 affixed to the upright 706 that move relative to the base 704 when an angle of the upright 706 is adjusted. The brace member 720, such as support plates 768, may provide sufficient lateral support and/or stability on the upright 706 to allow a user to move the user's lower body freely while supported by a lumbar decompression device.

A lumbar decompression device according to the present disclosure may provide a stable, self-supporting mechanism that may support a user's bodyweight while allowing the user to move their lower body through a variety of therapeutic movements relative to their upper body. Lateral movement, vertical movement, rotation, and other movements of the lower body may be performed without interference from or contact with the lumbar decompression device.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A lumbar decompression device, the device comprising:

at least one base;

at least one upright connected to the at least one base, wherein at least a portion of the at least one upright is oriented at an angle from the base in a range of 45° to 80° to provide stability while supporting a weight of a user and to provide sufficient space to move a user's lower body relative to a user's upper body while suspended; and a plurality of upper support members supported by the at least one upright, each upper support member being elongate, having a first free end and a second free end, and being supported by the at least one upright at a location disposed between the first free end and the second free end, the upper support members being configured to have at least a portion of the upper support member in contact with at least a portion of the torso area of the user so as to support a portion of the weight of the user, the plurality of upper support members being spaced sufficiently apart to allow the user to be suspended therebetween.

2. The device of claim 1, wherein the at least one upright comprises a first upright and a second upright and the plurality of upper support member comprises a first upper support member and a second upper support member, the first upright connecting a first upper support member to the at least one base and the second upright connecting a second upper support member to the at least one base.

3. The device of claim 2, wherein a first lower support member is connected to the first upright between the first upper support member and the at least one base, and a second lower support member is connected to the second upright between the second upper support member and the at least one base.

4. The device of claim 2, wherein the first upright and second upright are both connected to a single base.

5. The device of claim 1, further comprising an upright hinge connecting the at least one upright to the at least one base, wherein the angle of the at least one upright is adjustable relative to the base.

6. The device of claim 1, further comprising a plurality of lower support members configured to support at least another portion of the weight of the user, the lower support members connected to the at least one upright and each being configured to support a lower arm of the user.

7. The device of claim 6, wherein the plurality of lower support members further comprise a hand grip and each lower support member is configured to support a hand of the user.

8. The device of claim 6, wherein a length of the at least one upright is adjustable and a position of the plurality of lower support members is adjustable relative to the plurality of upper support members.

9. The device of claim 6, wherein at least one of the plurality of lower support members includes a support member sleeve that is slidably adjustable relative to the at least one upright.

10. The device of claim 6, wherein at least one of the plurality of lower support members includes a contact plate and the at least one upright includes one or more shelf plates, the one or more shelf plates configured to engage with the contact plate to support another portion of the weight of the user.

11. The device of claim 1, wherein the angle of the at least a portion of the at least one upright is an inward angle relative to the at least one base.

12. A lumbar decompression device, the device comprising:

a first base and a second base, the first base and the second base are configured to be moved independent of the other;

a first upright and a second upright, each of the uprights having a first end and a second end, the first end of the first upright being connected to the first base and the first end of the second upright being connected to the second base, the first base and the first upright being spaced apart from and unconnected to the second base and the second upright to allow the user of the lumbar decompression device to be disposed therebetween when using the device;

at least one brace member configured to reinforce the first upright in a forward and rearward direction relative to the first base; and a first upper support member connected to the second end of the first upright and a second upper support member connected to the second end of the second upright, the first upper support member being elongate and extending transversely to the first upright, having a first free end and a second free end, being supported by the first upright at a location disposed between the first free end and the second free end.

13. The device of claim 12, wherein each of the uprights forms an angle with one of the bases in a range of 45° to 80°.

14. The device of claim 12, wherein the first base and the second base each comprise a plurality of legs, each plurality of legs including at least one long leg and at least one short leg.

15. The device of claim 14, wherein each of the plurality of legs is pivotally connected to the first upright or second upright.

16. The device of claim 12, further comprising a first lower support member adjustably connected to the first upright and a second lower support member adjustably connected to the second upright.

17. The device of claim 16, wherein the first lower support member comprises a padded surface configured to support a forearm of a user.

18. The device of claim 12, wherein the first upper support member and the second upper support member have a convex upper surface.

19. A lumbar decompression device, the device comprising:

a pair of bases each being movable independently from the other;

a pair of uprights each having a first end and a second end, the first end of each of the pair of uprights being adjustably connected to a one of the pair of bases, the pair of uprights being unconnected to each other and independently movable so as to be spaced apart to allow the user of the lumbar decompression device to be generally vertically disposed therebetween when using the device;

a pair of brace members configured to reinforce the pair of uprights in a forward and rearward direction, a first brace member of the pair of brace members being connected to the first base at the first end of the first brace member and connected to a first upright of the pair of uprights at the second end of the first brace member, a second brace member of the pair of brace members being connected to the second base at the first end of the second brace member and connected to a second upright of the pair of uprights at the second end of the second brace member;

a pair of upper support members, each of the pair of upper support members being connected to the second end of the pair of uprights and a distance between the pair of upper support members defining a first width, each upper support member being elongate, having a first free end and a second free end, and being supported by one of the pair of uprights at a location disposed between the first free end and the second free end; and a pair of lower support members, each of the pair of lower support members being connected to the each of the pair of uprights between the first end and the second end thereof, a distance between the pair of lower support members defining a second width, the second width being greater than the first width.

20. The device of claim 19, wherein the pair of bases define a third width, the third width being less than the first width.

21. The device of claim 19, wherein each upright of the pair of uprights forming an angle with the support surface in a range of about 45° to 80°.

* * * * *